US007108161B2

(12) United States Patent
Wiebe

(10) Patent No.: US 7,108,161 B2
(45) Date of Patent: Sep. 19, 2006

(54) GARMENT HANGER

(76) Inventor: Jacob R. Wiebe, 60 Heaton Avenue, Winnipeg, Manitoba (CA) R3B 3E3

( * ) Notice: Subject to any disclaimer, the term of this patent is extended or adjusted under 35 U.S.C. 154(b) by 152 days.

(21) Appl. No.: 10/932,070

(22) Filed: Sep. 2, 2004

(65) Prior Publication Data

US 2005/0067446 A1 Mar. 31, 2005

(51) Int. Cl.
*A41D 27/22* (2006.01)

(52) U.S. Cl. ..... 223/85; 223/95

(58) Field of Classification Search ..... 223/85, 223/88, 92, 95, 97, 98
See application file for complete search history.

(56) References Cited

U.S. PATENT DOCUMENTS 2,091,506 A * 8/1937 Guttridge ..... 223/98
2,324,093 A * 7/1943 Lhamon ..... 223/88
3,733,016 A * 5/1973 Rood ..... 223/86
3,967,766 A * 7/1976 Hart ..... 223/85
3,980,228 A * 9/1976 Bisk ..... 223/88
4,160,516 A * 7/1979 Rice ..... 223/98
5,078,307 A * 1/1992 Suddath ..... 223/92
5,277,345 A * 1/1994 Ozaki ..... 223/98
5,680,972 A * 10/1997 Clarke ..... 223/88
6,126,049 A * 10/2000 Gish ..... 223/96
6,213,359 B1 * 4/2001 Gish ..... 223/98
6,481,603 B1 * 11/2002 Gish ..... 223/96
6,840,413 B1 * 1/2005 Cameron et al. ..... 223/98

* cited by examiner

*Primary Examiner*—Gary L. Welch
(74) *Attorney, Agent, or Firm*—Adrian D Battison; Ryan W. Dupuis; Michael R. Williams

(57) ABSTRACT

A garment hanger of the wire frame type includes an anti-slip member engaged over the wire rail to provide increased friction on the garment to reduce the tendency of the garment to slip off the wire rail. The anti-slip member forms an elongate generally cylindrical member along the wire rail with longitudinal ribs on the top surface and two depending fins on the underside each on a respective side of a narrow slot by which the member is engaged over the wire.

8 Claims, 2 Drawing Sheets

GARMENT HANGER

This invention relates to a garment hanger which includes a rail of circular cross-section formed of wire or plastics material or the like and which includes an additional plastics element over the rail which inhibits sliding of the garment from the hanger.

SUMMARY OF THE INVENTION

It is one object of the invention to provide an improved garment hanger which prevents garments such as trousers when hung over the wire rail from slipping.

According to one aspect of the invention there is provided a garment hanger comprising:

a frame shaped to define a wire hook top portion for hanging over a suitable support and a horizontal rail shaped to receive a garment draped over the rail such that a center section of the garment engages the rail and two ends of the garment drape downwardly on each side of the rail;

and an anti-slip member arranged to be engaged over the rail to provide increased friction, relative to the wire rail, on the garment to reduce the tendency of the garment to slip off the wire rail;

the anti-slip member comprising an elongate member having a length substantially equal to the length of the wire rail;

the ant-slip member having a slot along its length allowing it to engage over the rail by insertion of the rail into a hollow interior of the member through the slot such that the member surrounds the rail;

the anti-slip member having a series of longitudinal ribs along an upper surface extending generally radially outwardly from an axis of the rail for engaging the garment draped over the member on the rail to provide the increased friction in a direction transverse to the ribs;

and the anti-slip member having a fin projecting generally radially outwardly from the axis of the wire rail at a position generally opposite to the ribs so as to extend downwardly between the two ends of the garment such that rotation of the member around the rail is inhibited by engagement of the fin with one or other of the ends.

The arrangement is designed particularly for wire hangers which are inexpensive but most prone to slipping of the garment but can be used for any material hanger, particularly where the rail over which the garment is draped is of circular cross-section. Many plastic hangers thus have the same problem and can be solved in the same manner using a member which has an interior bore matching or just larger than the diameter of the rail so that it can be popped onto the rail and rotate relative to the rail.

Preferably there are two fins side by side, although one fin will suffice to prevent or inhibit rotation of the member around the wire which could allow the garment to slide off the hanger by rotation of the member.

Preferably the fin is on the side of the slot.

Conveniently there are two fins one on each side of the slot.

Preferably the member defines a cylindrical channel on its inner surface for loosely receiving the wire rail therein so that it can accommodate different diameters of wire and such that is can be readily inserted into place.

Preferably the slot is closed to a width less than the diameter of the wire to hold the member on the wire rail.

In accordance with two further separate features of the hanger preferably the wire is bent to form a second rail parallel to the first and above the first: and there is provided a name plate fastened to the wire at the base of the hook.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
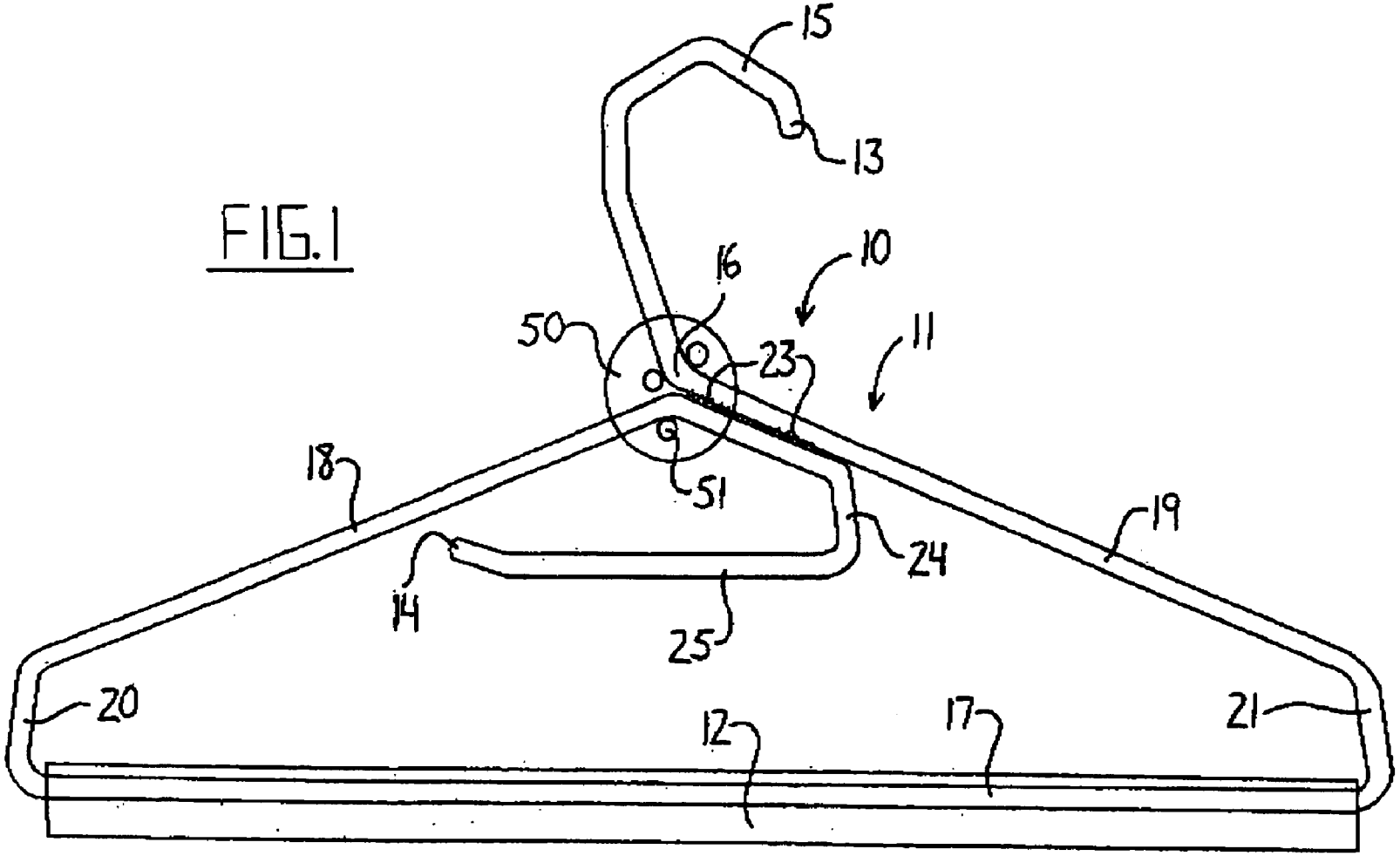
FIG. 1 is a front elevational view of a hanger according to the present invention.
Figure 3:
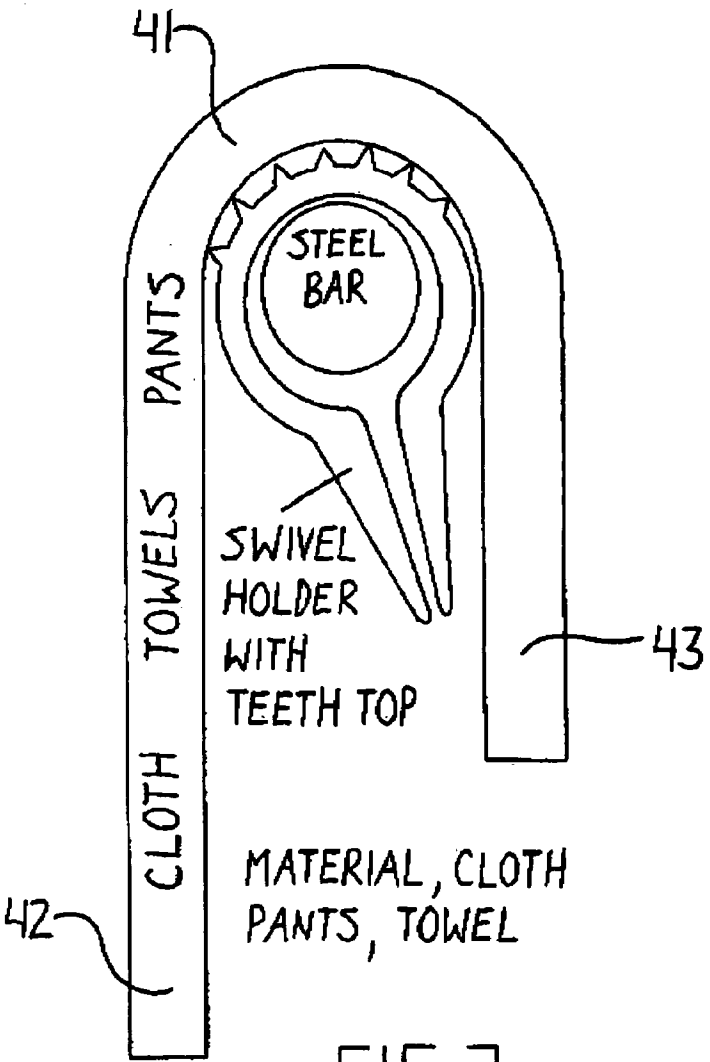
FIG. 3 is a similar cross sectional view showing the fins acting to prevent rotation of the member around the rail to prevent the garments from slipping.

The hanger 10 comprises a wire member 11 and an anti-slip member 12 inserted onto the wire member. The wire member is formed from a single piece of wire having a first end 13 and a second end 14. The wire member is bent to form a hook 15 at the first end 13 with the hook being curved downwardly to a junction point 16 at the base of the hook. The wire is further bent to form a horizontal rail 17 and two depending shoulders 18 and 19 which extend downwardly from the junction point 16 to respective ends of the rail 17. In the embodiment shown to generally vertical sections 20 and 21 are provided between the respective ends of the shoulder sections 18 and 19 and the ends of the rail 17.

At the junction section 16, a portion 22 adjacent the end 14 is bent downwardly to follow the line of the shoulder portion 18 and the downwardly inclined portion 22 is attached to the shoulder portion 19 by welding at 23. At the end of the portion 22, the wire is bent downwardly at 24 and then horizontally at 25 to form a second rail parallel to the first rail 17. The second rail is smaller and located within the confines of the wire hangar so as to provide a secondary support for a tie.

Figure 2:
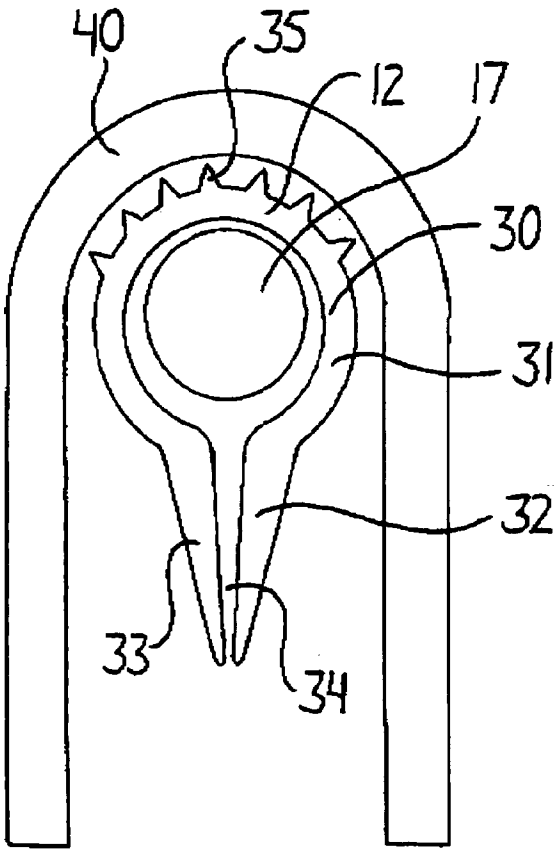
FIG. 2 is a cross sectional view through the rail and anti-slip member of the embodiment of FIG. 1.

The anti-slip member 12 is shown in cross section in FIG. 2 and comprises an elongate extruded body 30 forming a generally cylindrical shape at 31 and two fins at 32 and 33. Between the fins is defined a slot 34 which is relatively narrow so that it is smaller than the diameter of the wire rail 17. The wire rail is inserted into the slot by slight flexing of the fins 33 and 34 to push the fins apart so the wire can be pressed into the hollow cylindrical interior of the anti-slip member to be retained therein by the closing of the slot 34.

The top surface of the cylindrical member 30 carries a plurality of ribs 35 extending longitudinally along the member so as to act as friction elements engaging the underside of a garment 40. Thus the garment is prevented from slipping relative to the member by the ribs. The member is prevented from rotating around the rail by the fins 33 and 34 which project downwardly and thus engage one side of the garment. The garment includes an upper loop section 41 and 2 depending ends 42 and 43. Thus as the member tends to rotate, the tips of the fins come into contact with one end or other of the garment so that there is a significant increase in diameter around the axis of the rail so that sufficient moment is applied to the member to prevent it rotating around the axis of the rail. The length of the fins is just sufficient so that this increase in moment counteracts the tendency of the garment to slip which is generally due to an imbalance in the weight between the two ends 42 and 43. Thus the length of the fins must be sufficient to prevent the imbalance in the weight from continuing to cause the rotation. Thus the increase in mechanical advantage of the lighter side 43 of the garment caused by the increase in diameter around the axis counteracts the extra weight of the end 42.

At the junction 16 is provided a name plate 50 in the form of a circular plastic disc which is fastened to the junction by pins 51. Preferably the construction comprises a pair of such discs which are arranged on opposite sides of the wire frame and pop together by fasteners on the pins 51 from the pate on one side to the plate on the other side. This arrangement provides the ability for a retailer, manufacturer or other supplier to apply a logo or other information effectively onto the hanger in an attractive appearance without significantly increasing the cost of the product.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A garment hanger comprising:

a frame shaped to define a wire hook top portion for hanging over a suitable support and a horizontal rail of circular cross-section shaped to receive a garment draped over the rail such that a center section of the garment engages the rail and two ends of the garment drape downwardly on each side of the rail;

and an anti-slip member arranged to be engaged over the rail to provide increased friction, relative to the wire rail, on the garment to reduce the tendency of the garment to slip off the wire rail;

the anti-slip member comprising an elongate member having a length substantially equal to the length of the wire rail;

the ant-slip member having a slot along its length allowing it to engage over the rail by insertion of the rail into a hollow interior of the member through the slot such that the member surrounds the rail;

the anti-slip member having a series of longitudinal ribs along an upper surface extending generally radially outwardly from an axis of the wire rail for engaging the garment draped over the member on the rail to provide the increased friction in a direction transverse to the ribs;

and the anti-slip member having a fin projecting generally radially outwardly from the axis of the wire rail at a position generally opposite to the ribs so as to extend downwardly between the two ends of the garment such that rotation of the member around the rail is inhibited by engagement of the fin with one or other of the ends.

2. The garment hanger according to claim 1 wherein there are two fins side by side.

3. The garment hanger according to claim 1 wherein the fin is on the side of the slot.

4. The garment hanger according to claim 1 wherein there are two fins one on each side of the slot.

5. The garment hanger according to claim 1 wherein the member defines a cylindrical channel on its inner surface for loosely receiving the wire rail therein.

6. The garment hanger according to claim 1 wherein the slot is closed to a width less than the diameter of the wire to hold the member on the wire rail.

7. The garment hanger according to claim 1 wherein there is a second rail parallel to the first and above the first.

8. The garment hanger according to claim 1 wherein there is provided a name plate fastened to the wire at the base of the hook.

* * * * *